US008475242B2

(12) United States Patent
String

(10) Patent No.: US 8,475,242 B2
(45) Date of Patent: Jul. 2, 2013

(54) COIN SORTING PLATE WITH RECESSED COIN SLOTS

(76) Inventor: Gregory F. String, Mechanicsburg, PA (US)

( * ) Notice: Subject to any disclaimer, the term of this patent is extended or adjusted under 35 U.S.C. 154(b) by 51 days.

(21) Appl. No.: 13/191,595

(22) Filed: Jul. 27, 2011

(65) Prior Publication Data

US 2012/0276828 A1 Nov. 1, 2012

Related U.S. Application Data

(60) Provisional application No. 61/373,322, filed on Aug. 13, 2010.

(51) Int. Cl.
*G07D 3/00* (2006.01)

(52) U.S. Cl.
USPC ..... 453/12; 453/6; 453/49; 453/57

(58) Field of Classification Search
USPC ..... 453/6, 10, 12, 13, 33–36, 48, 57, 453/49
See application file for complete search history.

(56) References Cited

U.S. PATENT DOCUMENTS

| | | | | |
|---|---|---|---|---|
| 4,360,034 | A | 11/1982 | Davila et al. | |
| 4,543,969 | A | 10/1985 | Rasmussen | |
| 4,564,036 | A | 1/1986 | Ristvedt | |
| 5,194,037 | A | 3/1993 | Jones et al. | |
| 5,209,696 | A * | 5/1993 | Rasmussen et al. | 453/10 |
| 5,285,883 | A * | 2/1994 | Le Hong et al. | 194/317 |
| 5,425,669 | A | 6/1995 | Geib et al. | |
| 5,453,047 | A | 9/1995 | Mazur et al. | |
| 5,474,495 | A * | 12/1995 | Geib et al. | 453/3 |
| 5,584,758 | A | 12/1996 | Geib | |
| 5,782,686 | A | 7/1998 | Geib et al. | |
| 5,997,395 | A | 12/1999 | Geib et al. | |
| 6,039,644 | A * | 3/2000 | Geib et al. | 453/10 |
| 6,139,418 | A | 10/2000 | Geib et al. | |
| 6,609,604 | B1 * | 8/2003 | Jones et al. | 194/302 |
| 6,640,956 | B1 | 11/2003 | Zwieg et al. | |
| 6,679,770 | B1 * | 1/2004 | Sugai et al. | 453/10 |
| 6,755,730 | B2 | 6/2004 | Geib et al. | |
| 6,892,871 | B2 | 5/2005 | Strauts et al. | |
| 7,188,720 | B2 | 3/2007 | Geib et al. | |
| 7,243,774 | B2 * | 7/2007 | String | 194/350 |

(Continued)

FOREIGN PATENT DOCUMENTS

| | | | |
|---|---|---|---|
| RU | 2163031 | C2 | 2/2001 |
| WO | 2007101886 | A2 | 9/2007 |

OTHER PUBLICATIONS

International Search Report and Written Opinion of the International Searching Authority, corresponding PCT Application PCT/US2012/047185, Oct. 4, 2012, 5 pages.

*Primary Examiner* — Jeffrey Shapiro
(74) *Attorney, Agent, or Firm* — Hooker & Habib, P.C.

(57) ABSTRACT

A coin sorting plate for receiving and sorting a stream of coins by the diameter and hence the denomination of the coin has a number of coin recesses that extend along the path of the coin stream. Each coin recess is sized to receive a respective coin diameter. The coin recesses are arranged with the recess openings increasing in size in the downstream direction to progressively remove coins in order of increasing diameter. Each coin recess is bounded by a downstream wall that forces a coin in the recess to move off a peripheral edge of the coin sorting plate for collection or other processing.

18 Claims, 3 Drawing Sheets

U.S. PATENT DOCUMENTS

| | | | | |
|---|---|---|---|---|
| 7,438,172 | B2 | 10/2008 | Long et al. | |
| 2003/0019716 | A1* | 1/2003 | Sugai et al. | 194/216 |
| 2003/0124966 | A1* | 7/2003 | Hino et al. | 453/14 |
| 2003/0234153 | A1 | 12/2003 | Blake et al. | |
| 2005/0287941 | A1* | 12/2005 | Hill et al. | 453/10 |
| 2006/0154589 | A1* | 7/2006 | String | 453/11 |
| 2011/0189932 | A1* | 8/2011 | Adams et al. | 453/3 |

* cited by examiner

COIN SORTING PLATE WITH RECESSED COIN SLOTS

FIELD OF THE DISCLOSURE

The disclosure relates generally to the field of coin processing machines that sort or verify coins based on the diameter of the coins, and in particular the disclosure relates to a coin sorting plate for a coin processing machine.

BACKGROUND OF THE DISCLOSURE

A conventional coin processing machine as disclosed in my U.S. Pat. No. 7,243,774 includes a circular sorting plate. A single-layer stream of coins are introduced on an upper surface of the sorting plate, and are urged by centrifugal force against a peripheral wall extending along the outside of the plate. A rotating disk above the sorting plate has fingers that extend down and engage the coins. The fingers urge the coins circumferentially in a downstream direction around the disk, with the radially outer edges of the coins bearing against the wall.

The sorting plate has circumferentially-spaced openings adjacent the wall. Each opening extends through the thickness of the sorting plate and is associated with a specific diameter or denomination of coin. The opening is sized such that a coin of that denomination can fall through the opening and be sorted from the other coins that merely pass over the opening. When sorting coins by denomination, the openings increase in size in the downstream direction to progressively remove coins in order of increasing diameter.

A problem with a conventional coin sorting plate is that coins may not fall through an opening before striking the downstream wall defining the coin opening. This is particularly a problem when attempting to run the coin sorting machine at a relatively high speed. An upstream coin may then engage and press the coin against the wall such that the coin cannot fall through the opening, thereby jamming the machine.

Thus there is a need for an improved coin sorting plate that separates a single-layer stream of coins by diameter of coin that reduces the risk of jamming when operated at high speed.

BRIEF SUMMARY OF THE DISCLOSURE

Disclosed is an improved coin sorting plate for a coin sorting machine that reduces the risk of jamming when operated at high speed.

An embodiment of a coin sorting machine includes a stationary coin sorting plate, a rotatable drive plate with drive fingers above the coins sorting plate to drive the coins in a downstream circumferential direction on the plate, a peripheral wall extending around at least a portion of the sorting plate, coin receiving recesses along the peripheral wall, each recess recessed only a partial thickness of the coin sorting plate and associated with a respective coin diameter, each coin receiving recess sized to receive in the recess coins no larger than the respective coin diameter associated with such recess, and a downstream wall facing the recess that directs a coin in the recess off the coin sorting plate.

In one possible embodiment the peripheral wall extends along the outer or inner periphery of the sorting plate. Openings in the wall at the downstream ends of the recesses permit the coins to leave the sorting plate through the wall.

In another possible embodiment the peripheral wall defines an inner periphery. The downstream wall directs coins outwardly away from the wall and off the coin sorting plate.

In preferred embodiments each coin receiving recess includes an upstream, uniform radial-width section that receives coins into the recess and a downstream recess section faced by the downstream wall. The uniform width section preferably has a downstream length sufficient to enable the section to receive two touching coins in the recess.

In yet other preferred embodiments a coin proximity sensor is mounted in each recess. The sensor has a sensor surface that is essentially flush with the recess surface. The coin proximity sensor is preferably located in the uniform width section immediately adjacent the downstream wall to sense the presence of coins at the downstream end of the section. The sensor has a sufficiently small sensor diameter that two touching coins in the recess can be separately sensed by the sensor.

Using the disclosed coin receiving recesses has a number of advantages. Coins only need to drop a relatively short distance into a recess, and so the risk of jamming is substantially reduced at higher operating speeds. The downstream wall affirmatively directs coins in the recess off the coin sorting plate, enabling the coins to move at high speeds off the coin sorting plate. The downstream wall can direct coins either in the radially inner or radially outer direction off the coin sorting plate, enabling a more compact overall assembly or providing more space for coin receiving bags and the like. Sensing individual coins in the recesses is more reliable and can easily individually count even two touching coins.

Other objects and features of the disclosure will become evident as the description proceeds, especially when taken in conjunction with the accompanying three drawing sheets.

DESCRIPTION OF THE PREFERRED EMBODIMENTS

Figure 1:
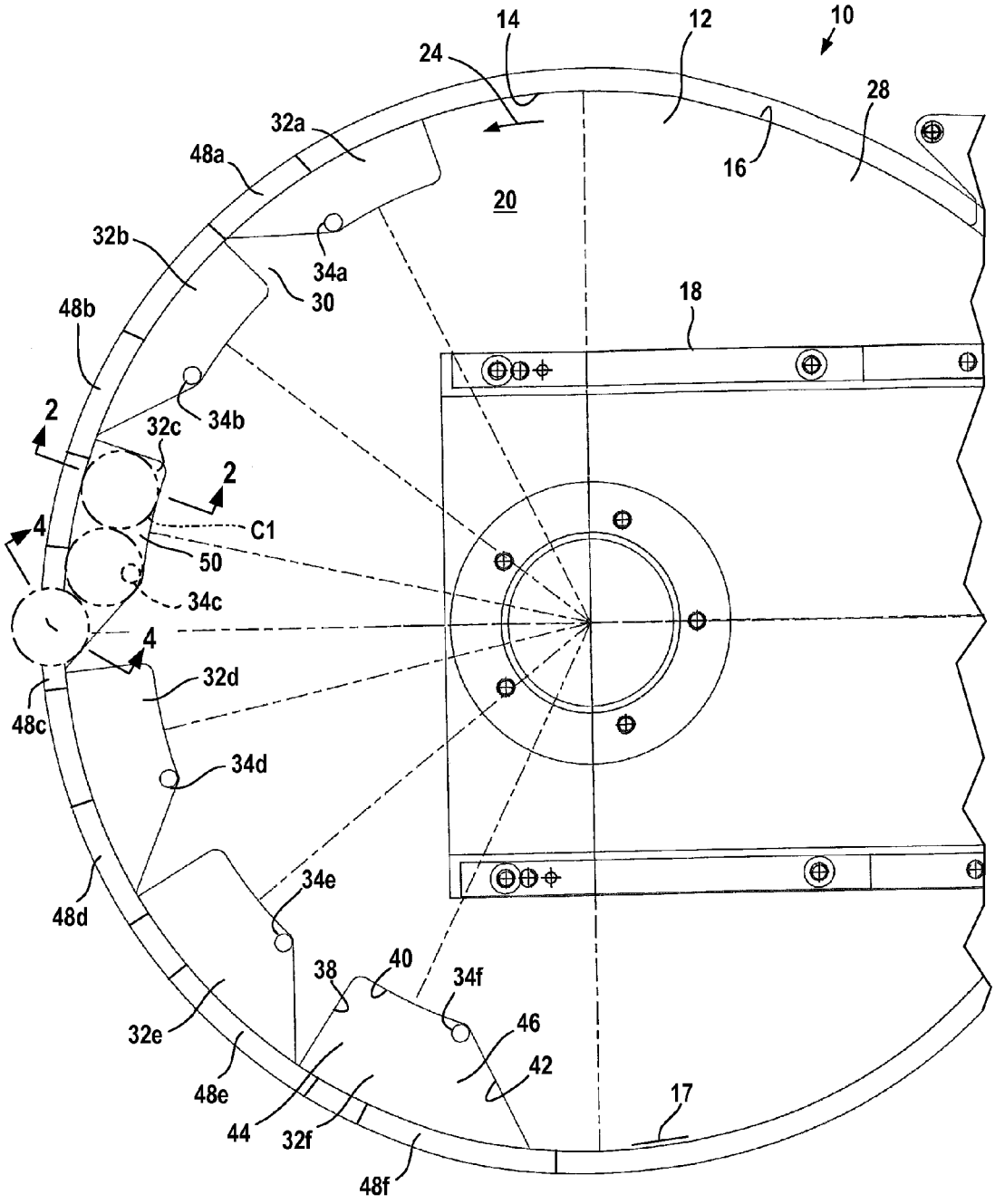
FIG. 1 is a top view of a coin sorting plate of a coin processing machine.
Figure 2:
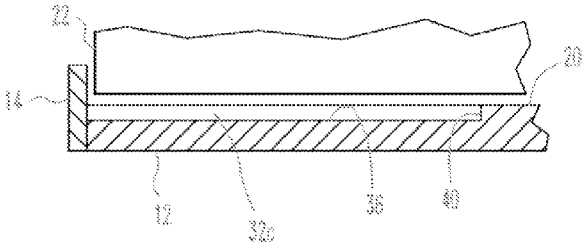
FIG. 2 is a vertical sectional view of the coin processing machine taken along line 2-2 of FIG. 1 and through a coin receiving recess of the coin sorting plate.

FIGS. 1 and 2 illustrate a portion of a coin processing machine 10 that utilizes a stationary coin sorting plate 12. The coin processing machine 10 also includes an outer peripheral wall 14 that extends around the outer periphery 16 of the sorting plate 12 and a conventional rotatable upper disk (whose outer edge is represented by the arc segment 17) carried on a mounting structure 18 that extends over the sorting plate 12. The upper disk is located above and faces an upper coin support surface 20 of the sorting plate and carries a number of conventional flexible, circumferentially spaced fingers 22 (see FIG. 2). Each finger 22 extends radially from the axis of rotation of the upper disk and is closely spaced from the coin support surface 20.

The upper disk rotates in the direction of the arrow 24 so that the fingers 22 engage and drive coins along the surface 20 in a downstream direction (counterclockwise as viewed in FIG. 1) along a coin path 26 that extends along the outer periphery of the coin sorting plate 12.

The coin sorting plate 12 has an intake portion 28 that receives a stream of singulated coins on the coin support surface 20 and a downstream coin sorting portion 30 that sorts the coins by diameter (denomination). The coin sorting portion 30 includes a plurality of coin recesses 32, each recess 32 associated with a respective coin diameter. A proximity sensor 34 is mounted in each recess 32.

The illustrated coin sorting plate 12 is adapted for sorting US coins and has six recesses 32*a*, 32*b*, 32*c*, 32*d*, 32*e*, and 32*f* that are spaced downstream along the coin path 26 in order of increasing coin diameter—dime, penny, nickel, quarter, half-dollar and dollar respectively.

Each coin recess 32 includes a flat floor 36 recessed from the coin support surface 20 a distance less than the thickness of the thinnest coin to be sorted (a dime in this embodiment). In the illustrated embodiment each recess floor 36 is spaced 0.033 inches from the support surface 20. The floor 36 extends radially inwardly from the coin plate's outer periphery 16 and is bounded by vertical walls extending between the floor 36 and the plate support surface 20. These walls include an upstream wall 38, a radially inner circumferential wall 40, and a downstream wall 42. The sensor 34 in the recess is located immediately adjacent the intersection of the inner wall 40 and the downstream wall 42.

The inner wall 40 of the recess 32 defines the radial width of the recess such that a coin of the diameter associated with the recess will be closely received in the recess. The floor 36 extends in a downstream circumferential direction from the upstream wall 38 a distance sufficient for two like coins to be received in the recess 32. The downstream wall 42 extends radially outwardly and circumferentially downstream from the inner wall 40 to the outer periphery 16.

The inner wall 40 extends along and defines a coin receiving portion 44 of the recess 32 that receives coins into the recess and a coin ejecting portion 46 of the recess 32 that tapers inwardly to the downstream end of the recess 34.

Each finger 22 is spaced from the coin support surface 20 a distance sufficient for the finger 22 to engage and press against the thinnest coin when received in a recess 32 (in the illustrated embodiment the fingers 22 can engage and press against a dime in the recess 32*a*).

The outer wall 14 has wall openings 48 that are associated with respective coin recesses 32. Each wall opening 48*a*-48*f* ends at the end of the associated recess 32*a*-32*f* and extends downward from the top of the wall 14 to at least the recess floor 36. Each wall opening 48*a*-48*f* extends upstream a distance sufficient to enable a coin of the diameter associated with the recess to pass through the opening 48. In other words, wall openings 48*a*-48*f* are sized to receive a dime, penny, nickel, quarter, half dollar, and dollar through the respective opening.

Operation of the coin processing machine 10 is discussed next. The coin processing machine 10 delivers a single-layered stream of coins onto the coin receiving portion of the coin sorting plate against the peripheral wall 14 and between the fingers 22 of the upper disk. The wall 14 guides the stream of coins along a coin path 28 that extends and against the outer wall 14 in a conventional manner. The coins are preferably spaced apart from one another in the stream and not touching as is known in the coin processing art.

The drive fingers 22 engage and drive the coins downstream along the coin path 22 and into the coin processing region X. The axis of rotation of the upper disk is preferably offset from the center of the sorting disk 12 as is known in the art to maintain the moving coins against the outer wall 14.

The coins first come to the first coin recess 32*a*. Coins larger than a dime pass over the coin recess 32*a* and continue to move downstream on the coin support surface. Each dime falls into the coin recess 32*a* and is supported on the recess floor 36. The fingers 22 continue to engage and drive the dime in a downstream direction in the recess 32*a*. The dime passes over the sensor 34 that signals the presence of the dime for counting or verification purposes. The dime engages the downstream wall 42 and is forced to follow along the wall 42, through the wall opening 48*a*, and is thereby ejected from the coin sorting plate 12 for collection or further processing.

The stream of coins then comes to the second coin recess 32*b*, and penny coins are sensed and then removed from the coin sorting plate 12 by falling into the recess 32*b* and being forced off the coin sorting plate 12. The stream of coins then sequentially come to the coin recesses 32*c*, 32*d*, 32*e*, 32*f* where the nickels, quarters, half-dollars and dollars fall into the associated coin recesses and are sensed and then ejected from the coin sorting plate 12.

Figure 3:
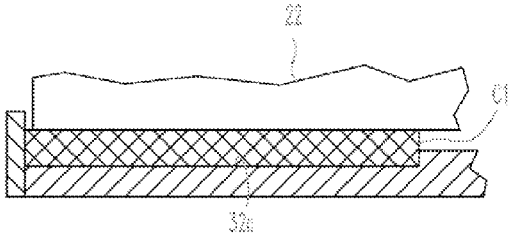
FIG. 3 is similar to FIG. 2 but with a coin in the coin recess.
Figure 4:
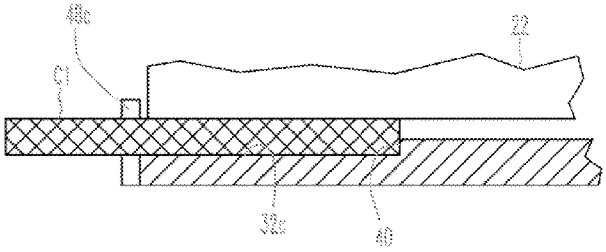
FIG. 4 is similar to FIG. 3 but is taken along line 4-4 of FIG. 1.

FIGS. 1, 3, and 4 illustrate a nickel C1 received in the nickel recess 32*c* and then being ejected from the recess 32*c*. As shown in FIG. 3, the nickel is closely received in the coin recess 32*c* with the top of the nickel engaged by and driven downstream in the recess 32*c* by the disk finger 22. The downstream wall 42*c* forces the nickel to also move outward through the wall opening 48*c* and off the coin sorting plate 12.

FIG. 1 also illustrates that two nickels that are touching each other in the coin stream can fall into the recess and be received into the coin receiving portion 44 of the recess 32*c*. As the lead nickel passes over the sensor 34, the sensor senses it. Note that there is a gap 50 between the two touching nickels along the inner wall 40. This gap 50 will pass over the sensor 34, enabling the sensor 34 to "turn off" prior to the trailing nickel moving over the sensor 34. This enables the two nickels to be separately sensed and counted even if they enter the recess 32*c* touching.

Figure 5:
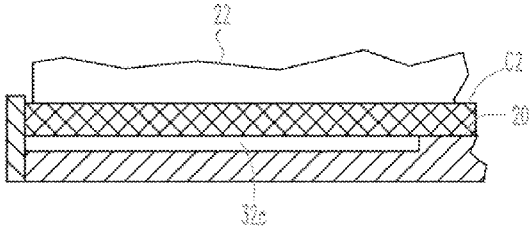
FIG. 5 is a view similar to FIG. 2 but with a coin passing over the coin recess.

FIG. 5 illustrates a quarter C2 passing over the nickel recess 32*c*. The quarter has too large of a diameter to fall into the nickel recess 32*c*. The radially inner edge of the quarter C2 remains against the coin support surface 20. The force applied against the quarter C2 by the disk finger 22 maintains the quarter C2 in the horizontal position shown in the figure as the quarter C2 moves over and then past the nickel coin recess 32*c*. The finger 22 also resists radially outward movement of the quarter C2 as the quarter C2 moves past the wall opening 48*c*. The quarter C2 passes over the sensor 34*c* in the recess 32*c* but is spaced above the sensor 34*c* to not be "seen" or detected by the sensor 34*c*.

Figure 6:
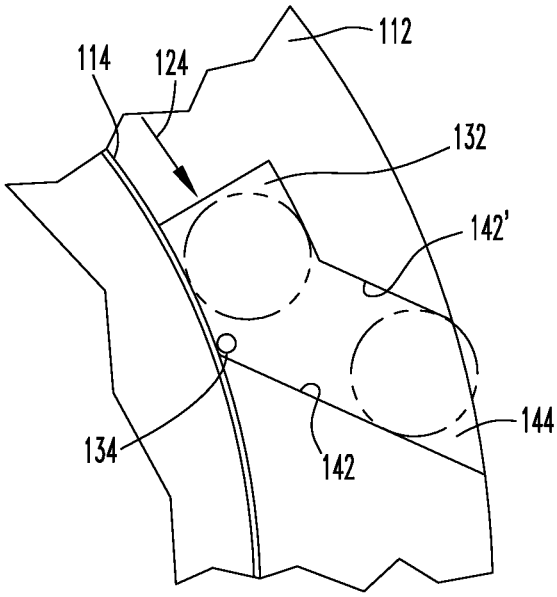
FIG. 6 is a top view of a portion of a second embodiment coin sorting plate.

FIG. 6 illustrates a portion of a second embodiment coin sorting plate 112 that has a radially-inner peripheral wall 114 extending around an inner periphery of the sorting plate 112. Coins are driven in a downstream direction 124 along the inner wall 114 by the upper disk for sorting. The coin sorting plate 112 has a number of coin recesses 132 (to simplify the drawing, only one coin recess is shown) that each carry a coin sensor 134.

Each coin recess 132 extends along the inner wall 114 and has a radial width sized to closely receive a coin of the diameter associated with the coin recess in the recess as previously described. In this embodiment the downstream wall 142 extends from the inner wall 114 and directs the coin in the recess radially outwardly off the outer periphery of the sorting plate 112. The inner wall 114 has no openings along the coin recesses 132, instead the downstream wall 142 cooperates with a second parallel wall 142' to define a coin chute 144 that extends to the edge of the coin sorting plate 112.

The coin sensor 134 is located immediately adjacent the intersection of the inner wall 114 and the downstream wall 142 so that the gap between touching coins in the recess will pass over the sensor 134 to enable individual sensing and counting of the two coins.

Figure 7:
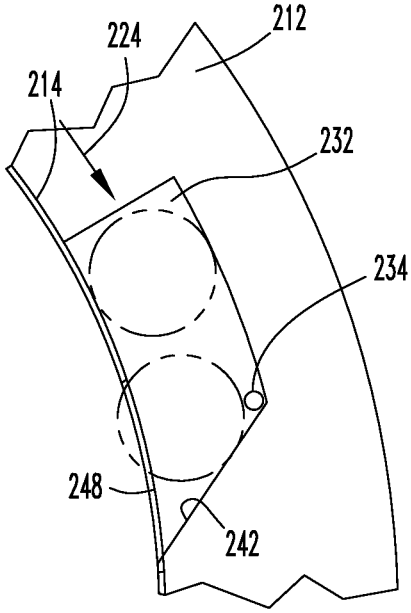
FIG. 7 is a top view of a portion of a third embodiment coin sorting plate.

FIG. 7 illustrates a portion of a third embodiment coin sorting plate 212 that has a radially-inner peripheral wall 214 extending around an inner periphery of the sorting plate 212. Coins are driven in a downstream direction 124 along the inner wall 214 by the upper disk for sorting. The coin sorting plate 212 has a number of coin recesses 232 (to simplify the drawing, only one coin recess is shown) similar to the coin recesses 32 that each carry a coin sensor 134.

Each coin recess 132 extends along the inner wall 114 and has a radial width sized to closely receive a coin of the diameter associated with the coin recess in the recess as previously described. In this embodiment the downstream wall 242 extends from the outer radial wall 240 towards the inner wall 214 and directs the coin in the recess through an opening 242 in the inner wall 214.

The coin sorting plates 12, 112, 212 can also be configured to verify coins rather than sort coins. A coin sorting plate 12, 112, 212 for verifying coins of a specific diameter could include three coin recesses: a coin recess sized to receive coins of the specific diameter, an upstream coin recess sized to receive all smaller diameter coins, and a downstream coin recess sized to receive all larger diameter coins. If the coins are all of the specified diameter, no coins would be discharged from or sensed in the upstream or downstream coin recesses.

Although the illustrated embodiment coin processing machine sorts or verifies coins used as legal currency, it is understood the term "coins" also includes tokens, disks, and the like that may not necessarily be legal currency.

While I have illustrated and described preferred embodiments, it is understood that this is capable of modification, and I therefore do not wish to be limited to the precise details set forth, but desire to avail myself of such changes and alterations as fall within the purview of the following claims.

What I claim as my invention is:

1. A coin processing machine to separate coins of a predetermined diameter from a stream of coins, the coin processing machine comprising:

a stationary coin sorting plate, a peripheral wall extending around at least a portion of the coin sorting plate, the peripheral wall having an upper portion extending above the coin sorting plate, and a rotatable drive plate, the drive plate having drive fingers that extend from the drive plate towards the coin sorting plate and move in a downstream direction to drive coins on said sorting plate in said downstream direction;

the coin sorting plate comprising an upper surface facing the drive fingers, the coin path on said upper surface, and a coin recess on the coin path, the recess on the periphery of the coin sorting plate adjacent to and extending in a downstream direction along the wall to a downstream end of the recess, the recess having a floor recessed into the coin sorting plate and spaced from the upper surface of the coin sorting plate, the recess disposed to receive coins having a diameter equal to or less than the predetermined diameter moving along the coin path into the recess, the recess floor bounded by a second wall, the second wall extending in a downstream direction to the downstream end of the recess, the second wall also extending to a periphery of the coin sorting plate, wherein the recess wall comprises a first portion extending substantially parallel with the peripheral wall and a second portion extending from the first portion to the periphery of the coin sorting plate.

2. The coin processing machine of claim 1 wherein the peripheral wall is adjacent to an outer periphery of the coin sorting plate, the second wall extends to the outer periphery of the plate, and the peripheral wall includes an opening extending upstream from the downstream end of the recess.

3. The coin processing machine of claim 1 wherein the peripheral wall is adjacent to an inner periphery of the coin sorting plate, and the second wall extends from the inner periphery of the coin sorting plate to an outer periphery of the coin sorting plate.

4. The coin processing machine of claim 1 wherein the peripheral wall extends along an inner periphery of the coin sorting plate, the second wall extends to the inner periphery of the coin sorting plate, and the peripheral wall comprises an opening extending upstream from the downstream end of the recess.

5. The coin processing machine of claim 1 wherein the coin recess represents a first coin recess and the coin sorting plate comprises a plurality of coin recesses, the first coin recess being one of the plurality of coin recesses, each coin recess associated with and sized to receive a respective maximum diameter coin different from the other coin recesses.

6. The coin processing machine of claim 5 wherein the plurality of coin recesses are spaced apart in a downstream direction along the coin path in order of increasing coin diameter.

7. The coin processing machine of claim 6 wherein the coin sorting plate has no more than three coin recesses.

8. The coin processing machine of claim 1 comprising a coin sensor in the coin recess, the coin sensor configured to generate a signal in reaction to a coin moving through the coin recess.

9. The coin processing machine of claim 8 wherein the sensor has a surface essentially flush with the floor of the recess.

10. The coin processing machine of claim 8 wherein the sensor is located adjacent an end of the second wall spaced away from the downstream end of the recess.

11. The coin processing machine of claim 8 wherein the sensor is adjacent to the peripheral wall.

12. The coin processing machine of claim 8 wherein the sensor is spaced away from the peripheral wall.

13. The coin processing machine of claim 8 wherein the distance the recess floor is spaced from the upper surface of the coin sorting plate represents the recess depth, and the coin sensor cannot detect a coin spaced from the coin sensor a distance equal to the recess depth.

14. The coin processing machine of claim 1 wherein the coin of the predetermined diameter has a thickness and the recess floor is spaced from the upper surface of the coin sorting plate less than said coin thickness.

15. The coin processing machine of claim 1 wherein the drive fingers are spaced sufficiently close to the upper surface of the coin sorting plate to contact a coin in the recess.

16. The coin processing machine of claim 1 wherein the drive fingers exert sufficient force on an oversized coin passing over the coin recess to prevent any portion of the oversized coin from falling into the recess.

17. The coin processing machine of claim 2 wherein at least a portion of the wall opening is below the upper surface of the coin plate.

18. The coin processing machine of claim 1 wherein the second portion of the recess wall is substantially transverse to the periphery of the coin sorting plate where the second portion of the recess wall meets the periphery of the coin sorting plate.

* * * * *